US007629560B2

(12) United States Patent
Ptasienski

(10) Patent No.: US 7,629,560 B2
(45) Date of Patent: Dec. 8, 2009

(54) MODULAR LAYERED HEATER SYSTEM

(75) Inventor: Kevin Ptasienski, O'Fallon, MO (US)

(73) Assignee: Watlow Electic Manufacturing Company, St. Louis, MO (US)

( * ) Notice: Subject to any disclaimer, the term of this patent is extended or adjusted under 35 U.S.C. 154(b) by 0 days.

(21) Appl. No.: 11/238,747

(22) Filed: Sep. 29, 2005

(65) Prior Publication Data

US 2006/0065654 A1 Mar. 30, 2006

Related U.S. Application Data

(60) Provisional application No. 60/614,827, filed on Sep. 30, 2004.

(51) Int. Cl.
*H05B 3/16* (2006.01)
*H05B 3/02* (2006.01)

(52) U.S. Cl. ..... 219/543; 219/538

(58) Field of Classification Search ..... 219/543, 219/538, 542

See application file for complete search history.

(56) References Cited

U.S. PATENT DOCUMENTS

| | | | | |
|---|---|---|---|---|
| 3,313,920 | A | 4/1967 | Gallez | |
| 4,931,627 | A | 6/1990 | Watts | |
| 5,904,874 | A | 5/1999 | Winter | |
| 5,973,298 | A | 10/1999 | Juliano et al. | |
| 6,284,692 | B1 * | 9/2001 | Jue et al. | 501/103 |
| 6,559,419 | B1 * | 5/2003 | Sol et al. | 219/203 |
| 6,703,586 | B1 * | 3/2004 | Kast | 219/203 |
| 6,762,396 | B2 * | 7/2004 | Abbott et al. | 219/543 |
| 6,901,217 | B2 * | 5/2005 | Gamboa et al. | 392/484 |
| 7,002,115 | B2 * | 2/2006 | Gerhardinger et al. | 219/543 |
| 7,053,343 | B2 * | 5/2006 | Gerhardinger et al. | 219/543 |
| 2005/0115945 | A1 | 6/2005 | Kesteren et al. | |
| 2005/0199610 | A1 | 9/2005 | Ptasienski et al. | |
| 2005/0252908 | A1 | 11/2005 | Weiss | |

OTHER PUBLICATIONS

ISR and Written Opinon for PCT/US2005/035262.

* cited by examiner

*Primary Examiner*—Daniel L Robinson
(74) *Attorney, Agent, or Firm*—Brinks Hofer Gilson & Lione

(57) ABSTRACT

A heater system is provided that comprises a plurality of layered heater modules, each module comprising a plurality of resistive zones. The layered heater modules are disposed adjacent one another to form the heater system, which can be adapted for a multitude of different sizes of heating targets. Preferably, the resistive zones comprise a plurality of resistive traces arranged in a parallel circuit and oriented approximately perpendicular to a primary heating direction, wherein the resistive traces comprise a positive temperature coefficient material having a relatively high TCR. The resistive traces are responsive to the heating target power gradient such that the resistive traces output additional power proximate a higher heat sink and less power proximate a lower heat sink along the primary heating direction.

18 Claims, 7 Drawing Sheets

MODULAR LAYERED HEATER SYSTEM

CROSS-REFERENCE TO RELATED APPLICATIONS

This application is based upon Provisional Patent Application, Ser. No. 60/614,827, entitled "Modular Layered Heater System," filed Sep. 30, 2004, the contents of which are incorporated herein by reference in their entirety and continued preservation of which is requested.

FIELD OF THE INVENTION

The present invention relates generally to electrical heaters and more particularly to layered heaters for use in processing or heating a variety of sizes of heating targets such as glass panels for use in flat panel television displays, among other applications.

BACKGROUND OF THE INVENTION

Relatively large glass panels are used in the manufacturing of flat panel televisions, among other applications, in addition to much smaller panels for use in devices such as cell phone screens. During manufacturing, the glass is heated by a heater that is placed directly onto or proximate the surface of the glass. Often, the heater is custom designed for the specific size of the glass panel and thus for different sizes of glass, a heater is redesigned as a separate, unitary heater panel for each different glass size. Thus each size of glass panel has its own separate heater. Additionally, these separate, unitary heaters become larger and larger with larger glass panel sizes.

In some heater applications for these relatively large glass panels, the unitary heater is divided into sections or tiles that can be independently controlled in order to provide a different power distribution across the glass panel. Although each section can be independently controlled for a more tailored heat distribution, the heater remains unitary and is custom designed for the size of the glass panel that is being processed. Accordingly, a separate heater is used for each glass size, and thus a plurality of glass sizes results in a plurality of individual heaters.

Layered heaters are often used in the processing of these glass panels. A layered heater generally comprises layers of different materials, namely, a dielectric and a resistive material, which are applied to a substrate. The dielectric material is applied first to the substrate and provides electrical isolation between the substrate and the electrically-live resistive material and also minimizes current leakage to ground during operation. The resistive material is applied to the dielectric material in a predetermined pattern and provides a resistive heater circuit. The layered heater also includes leads that connect the resistive heater circuit to an electrical power source, which is typically cycled by a temperature controller. Further, the layered heater may comprise an over-mold material that protects the lead-to-resistive circuit interface. This lead-to-resistive circuit interface is also typically protected both mechanically and electrically from extraneous contact by providing strain relief and electrical isolation through a protective layer. Accordingly, layered heaters are highly customizable for a variety of heating applications.

Layered heaters may be "thick" film, "thin" film, or "thermally sprayed," among others, wherein the primary difference between these types of layered heaters is the method in which the layers are formed. For example, the layers for thick film heaters are typically formed using processes such as screen printing, decal application, or film printing heads, among others. The layers for thin film heaters are typically formed using deposition processes such as ion plating, sputtering, chemical vapor deposition (CVD), and physical vapor deposition (PVD), among others. Yet another series of processes distinct from thin and thick film techniques are those known as thermal spraying processes, which may include by way of example flame spraying, plasma spraying, wire arc spraying, and HVOF (High Velocity Oxygen Fuel), among others.

SUMMARY OF THE INVENTION

In one preferred form, the present invention provides a heater system that comprises a plurality of layered heater modules, each module comprising a plurality of resistive zones, wherein the layered heater modules are disposed adjacent one another to form the heater system. Preferably, the resistive zones comprise a plurality of resistive traces arranged in a parallel circuit and oriented approximately perpendicular to a primary heating direction or a plurality of heating directions. The resistive traces comprise a positive temperature coefficient (PTC) material having a relatively high temperature coefficient of resistance (TCR), wherein the resistive traces are responsive to a heating target power gradient such that the resistive traces output additional power proximate a higher heat sink and less power proximate a lower heat sink along the primary heating direction(s).

In another form, a layered heater module for use in a heater system is provided, wherein the module comprises a plurality of quadrants and a plurality of resistive traces disposed within each of the quadrants. In one form, the resistive traces form a parallel circuit within each quadrant, while in other forms, a series circuit is formed and a combination series-parallel series circuit is formed. Additionally, the resistive traces in each quadrant are arranged in a linear configuration, or alternately, the resistive traces in at least one quadrant are arranged in a linear configuration and the resistive traces in at least one other quadrant are arranged in an arcuate configuration.

According to a method of the present invention, a plurality of layered heater modules are arranged adjacent one another to substantially match the size of a heating target such as a glass panel. Accordingly, various sizes of heating targets may be heated by arranging a number of layered heater modules.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Corresponding reference numerals indicate corresponding parts throughout the several views of the drawings.

DETAILED DESCRIPTION OF THE PREFERRED EMBODIMENTS

The following description of the preferred embodiments is merely exemplary in nature and is in no way intended to limit the invention, its application, or uses.

Figure 1A:
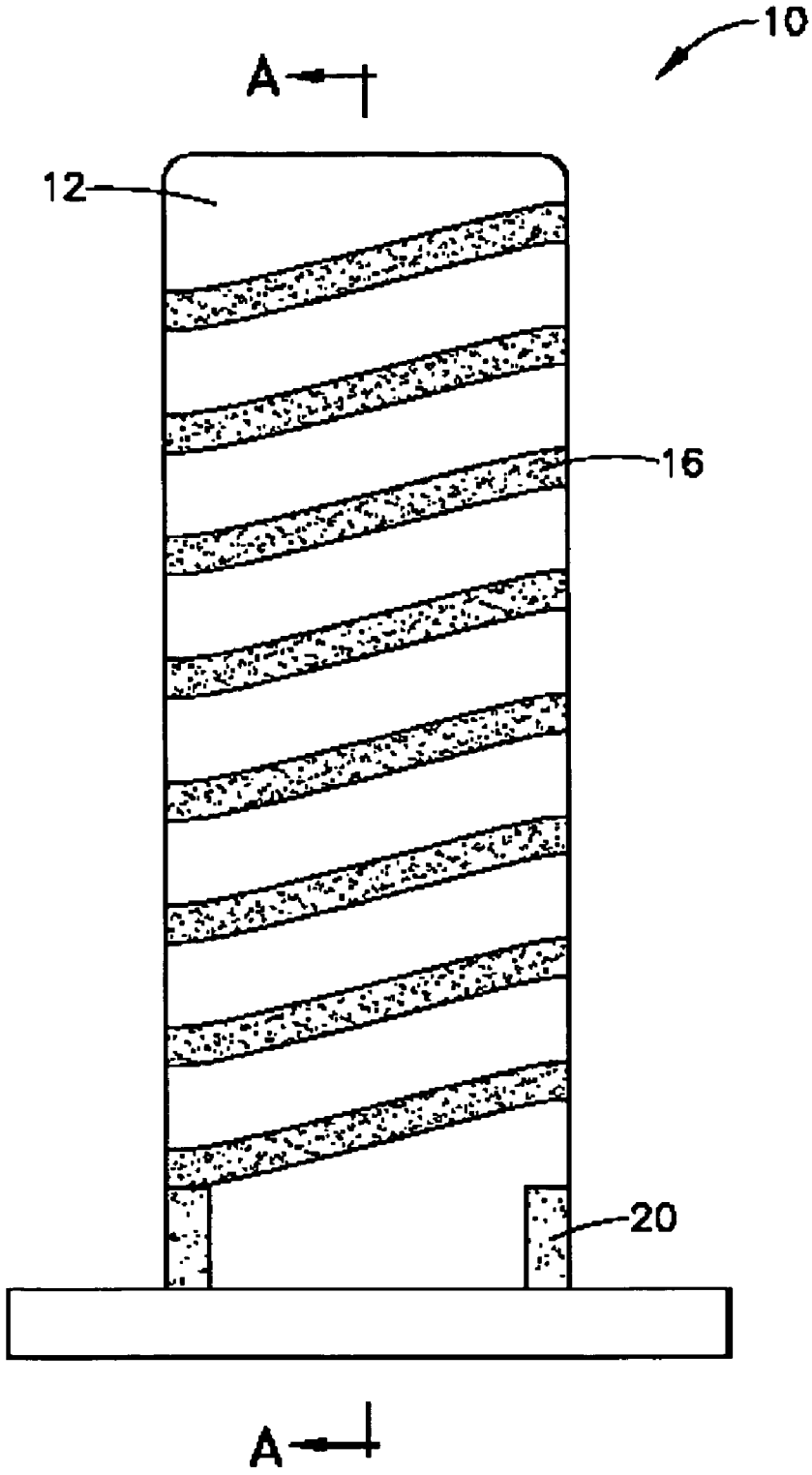
FIG. 1*a* is an elevated side view of a layered heater constructed in accordance with the principles of the present invention.
Figure 1B:
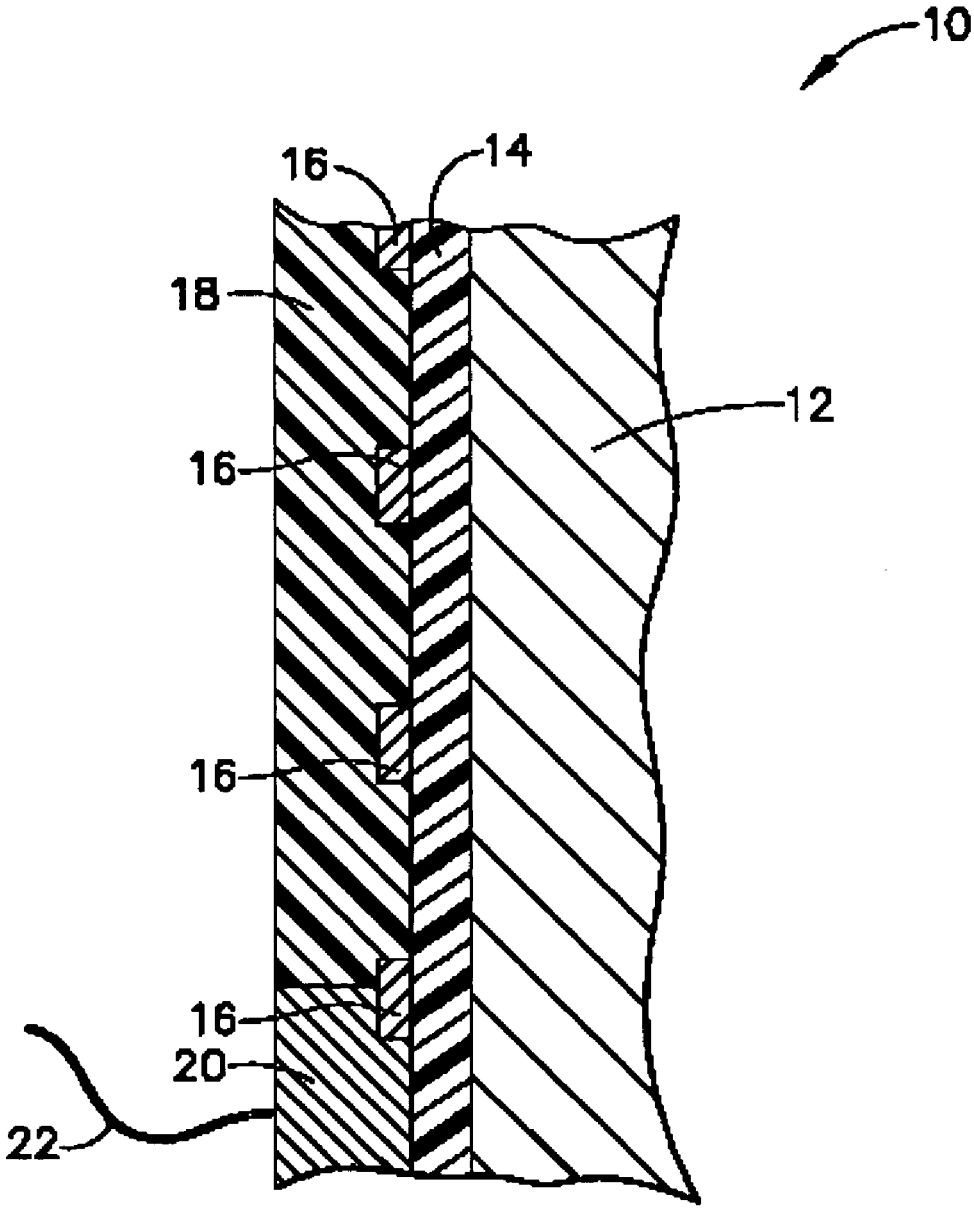
FIG. 1*b* is an enlarged partial cross-sectional side view, taken along line A-A of FIG. 1*a*, of a layered heater constructed in accordance with the principles of the present invention.

Referring to FIGS. 1*a* and 1*b*, a general illustration and description of a layered heater, which is indicated by reference numeral 10, is provided. Generally, the layered heater 10 comprises a number of layers disposed on a substrate 12, wherein the substrate 12 may be a separate element disposed proximate the part or device (not shown) to be heated, or the substrate 12 may be the part or device itself. The part or device is hereinafter referred to as a "heating target," which should be construed to mean any device, body, or medium that is intended to be heated such as a physical object or an environment adjacent the heater, e.g., air, fluid. Accordingly, the terms part, device, or target device, among others, should not be construed as limiting the scope of the present invention. The teachings of the present invention are applicable to any heating target, regardless of the form and/or composition of the heating target.

As best shown in FIG. 1*b*, the layers generally comprise a dielectric layer 14, a resistive layer 16, and a protective layer 18. The dielectric layer 14 provides electrical isolation between the substrate 12 and the resistive layer 16 and is formed on the substrate 12 in a thickness commensurate with the power output, applied voltage, intended application temperature, or combinations thereof, of the layered heater 10. The resistive layer 16 is formed on the dielectric layer 14 in a predetermined pattern and provides a heater circuit for the layered heater 10, thereby providing the heat to the substrate 12. The protective layer 18 is formed over the resistive layer 16 and is preferably an insulator, however other materials such as an electrically or thermally conductive material may also be employed according to the requirements of a specific heating application.

As further shown, terminal pads 20 are generally disposed on the dielectric layer 14 and are in contact with the resistive layer 16. Accordingly, electrical leads 22 are in contact with the terminal pads 20 and connect the resistive layer 16 to a power source (not shown). (Only one terminal pad 20 and one electrical lead 22 are shown for clarity, and it should be understood that two terminal pads 20 with one electrical lead 22 per terminal pad 20 are often present in layered heaters). The terminal pads 20 are not required to be in contact with the dielectric layer 14, so long as the terminal pads 20 are electrically connected to the resistive layer 16 in some form. As further shown, the protective layer 18 is formed on the resistive layer 16 and is generally a dielectric material for electrical isolation and protection of the resistive layer 16 from the operating environment. Additionally, the protective layer 18 may cover a portion of the terminal pads 20 as shown so long as there remains sufficient area to promote an electrical connection with the power source.

As used herein, the term "layered heater" should be construed to include heaters that comprise at least one functional layer (e.g., dielectric layer 14, resistive layer 16, and protective layer 18, among others), wherein the layer is formed through application or accumulation of a material to a substrate or another layer using processes associated with thick film, thin film, thermal spraying, or sol-gel, among others. These processes are also referred to as "layered processes," "layering processes," or "layered heater processes." Such processes and functional layers are described in greater detail in co-pending U.S. patent application Ser. No. 10/752,359, titled "Combined Layering Technologies for Electric Heaters," filed on Jan. 6, 2004, which is commonly assigned with the present application and the contents of which are incorporated herein by reference in their entirety.

Figure 2:
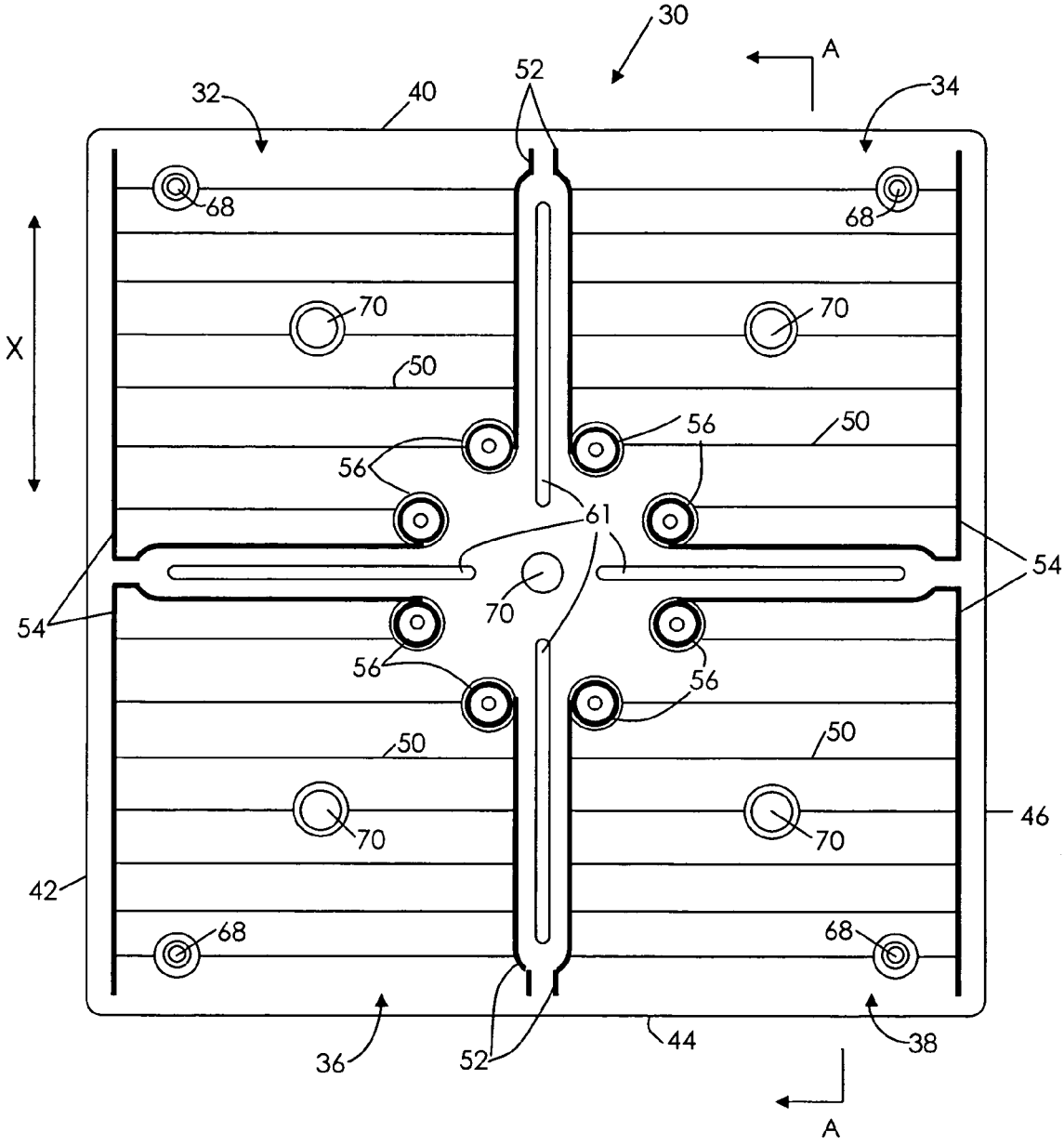
FIG. 2 is a top view of a layered heater module constructed in accordance with the principles of the present invention.
Figure 3:
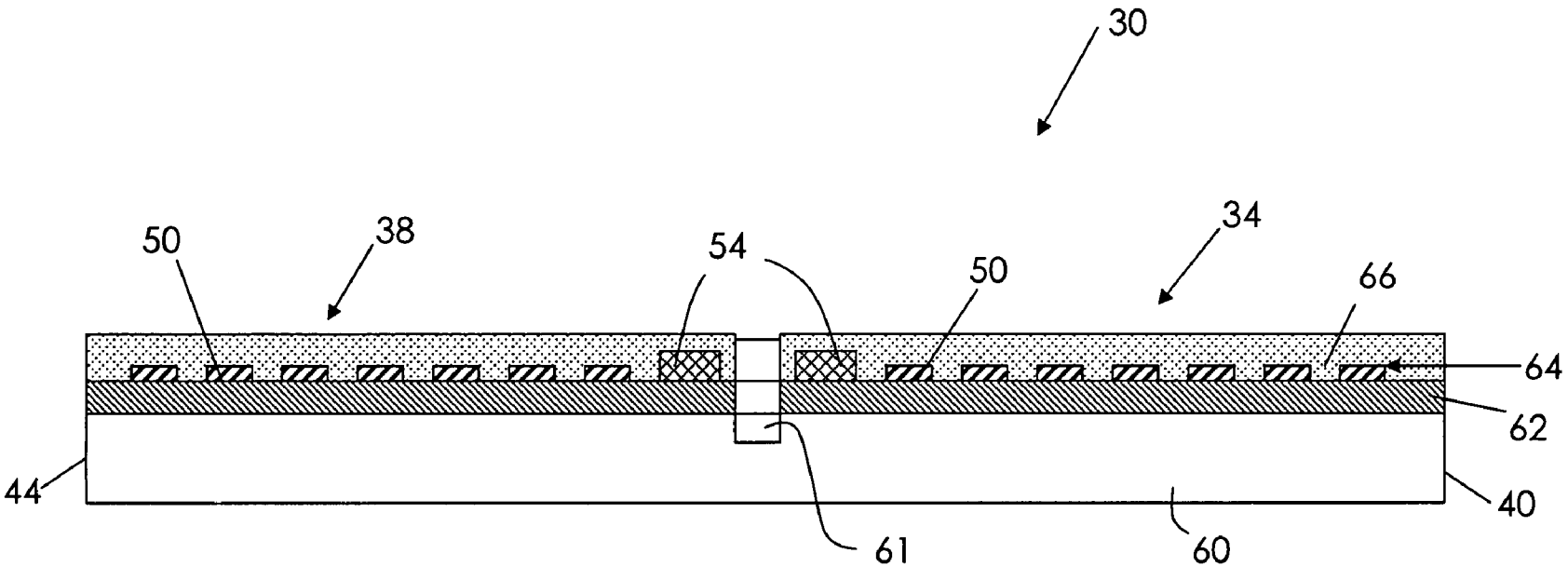
FIG. 3 is a cross-sectional view, taken along line A-A of FIG. 2 and rotated 90°, of the layered heater module in accordance with the principles of the present invention.

Referring now to FIGS. 2 and 3, one embodiment of a layered heater module for use in a heater system is generally illustrated and indicated by reference numeral 30. The layered heater module 30 comprises a plurality of resistive zones, which are preferably arranged in four quadrants 32, 34, 36, and 38 as shown in one form of the present invention. The layered heater module 30 also defines a rectangular configuration in the form as shown, which comprises edges 40, 42, 44, and 46. As described in greater detail below, a plurality of layered heater modules 30 may be placed adjacent one another along their edges 40, 42, 44, and 46 to form a heater system that is sized for a specific size of heating target, e.g. glass panel (not shown). Accordingly, the number of layered heater modules 30 placed adjacent one another may be altered to fit any number of heating target sizes, which is illustrated and described in greater detail below.

As further shown, each quadrant comprises a plurality of resistive traces 50 that are connected to power busses 52 and 54 such that each quadrant or zone comprises an independently controllable resistive circuit. Preferably, terminals 56 are connected to the power busses 52 and 54 for connection to lead wires (not shown). Although each quadrant or zone is capable of being independently controlled, the zones may be connected and controlled together rather than independently while remaining within the scope of the present invention.

In one form, the resistive traces 50 are arranged in a parallel circuit configuration as shown and are oriented approximately perpendicular to a primary heating direction, which is indicated by arrow X. Additionally, the material for the resistive traces is a positive temperature coefficient (PTC) material that preferably has a relatively high temperature coefficient of resistance (TCR).

In a parallel circuit, the voltage across each resistive trace 50 remains constant, and therefore, if the resistance in a particular resistive trace increases or decreases, the current must correspondingly decrease or increase in accordance with the constant applied voltage. Accordingly, with a PTC material having a relatively high TCR, the resistance of the resistive traces will decrease with the lower temperature associated with a heat sink. And with the constant voltage power supply, the current through the resistive traces 50 will increase with the decrease in resistance, thus producing a higher power output to compensate for the heat sinks. Accordingly, in the areas of higher heat sink, the power of the layered heater module 30 will increase to compensate for the heat sink, the concepts and additional embodiments of which are shown and described in greater detail in copending U.S. application titled "Adaptable Layered Heater System," filed Sep. 15, 2004, which is commonly assigned with the present application and the contents of which are incorporated by reference herein in their entirety. Thus, the resistive traces may alternately be arranged in a series circuit and have a negative temperature coefficient material with a relatively high BETA coefficient as described in this copending application. Further, it should be understood that a variety of circuit configurations may be employed while remaining within the scope of the present invention and additional circuit configurations are not illustrated herein for purposes of clarity.

Furthermore, the presence of quadrants 32, 34, 36, and 38 provides yet another level of fidelity in controlling the layered heater module 30 since each of the resistive trace circuits is capable of being independently controlled. Accordingly, each of the resistive trace circuits are adaptable and controllable according to the power demands of a heating target.

It should be understood that any number of resistive zones and circuit configurations for the resistive traces within these zones may be employed while remaining within the scope of the present invention. The illustration of four quadrants 32, 34, 36, and 38 as the resistive zones and of the resistive traces forming parallel circuits should not be construed as limiting the scope of the present invention. Materials and configurations for the resistive traces may also be employed in accordance with the teachings of copending U.S. application titled "Adaptable Layered Heater System," filed Sep. 15, 2004, which is commonly assigned with the present application and the contents of which are incorporated by reference herein in their entirety, while remaining within the scope of the present invention.

As further shown, the layered heater module 30 comprises a number of layers disposed on a substrate 60. The layers preferably comprise a dielectric layer 62, a resistive layer 64, and a protective layer 66, which are constructed and generally function as previously described in FIGS. 1*a* and 1*b*. Additionally, a plurality of grooves 61 are disposed between the four quadrants 32, 34, 36, and 38 to provide additional thermal isolation between the four quadrants 32, 34, 36, and 38. Preferably, the grooves 61 are machined into a substrate 60 to a depth commensurate to provide such isolation as shown.

The layered heater module 30 further comprises a plurality of apertures 68 that are preferably formed through the substrate 60 in order to mount the layered heater module 30 to a mounting device (not shown) that is used to suspend the layered heater modules 30 proximate the heating target. In one form, threaded studs (not shown) may be disposed on the heating target such that the layered heater module 30 may be placed onto the studs through the apertures 68 and secured with a nut. It should be understood that the apertures 68 are optional, the position and configuration of which may change according to a variety of mounting devices that are used in the processing of heating targets such as relatively large glass panels.

Additionally, the layered heater module 30 comprises a plurality of provisions for the mounting of a sensing device such as a thermocouple (not shown), which are illustrated as openings 70. Alternately, the provisions may be grooves or other features that provide for the mounting of such devices. Accordingly, the thermocouple is disposed within the opening 70 and provides temperature information for the control of each of the four quadrants 32, 34, 36, and 38.

Figure 4:
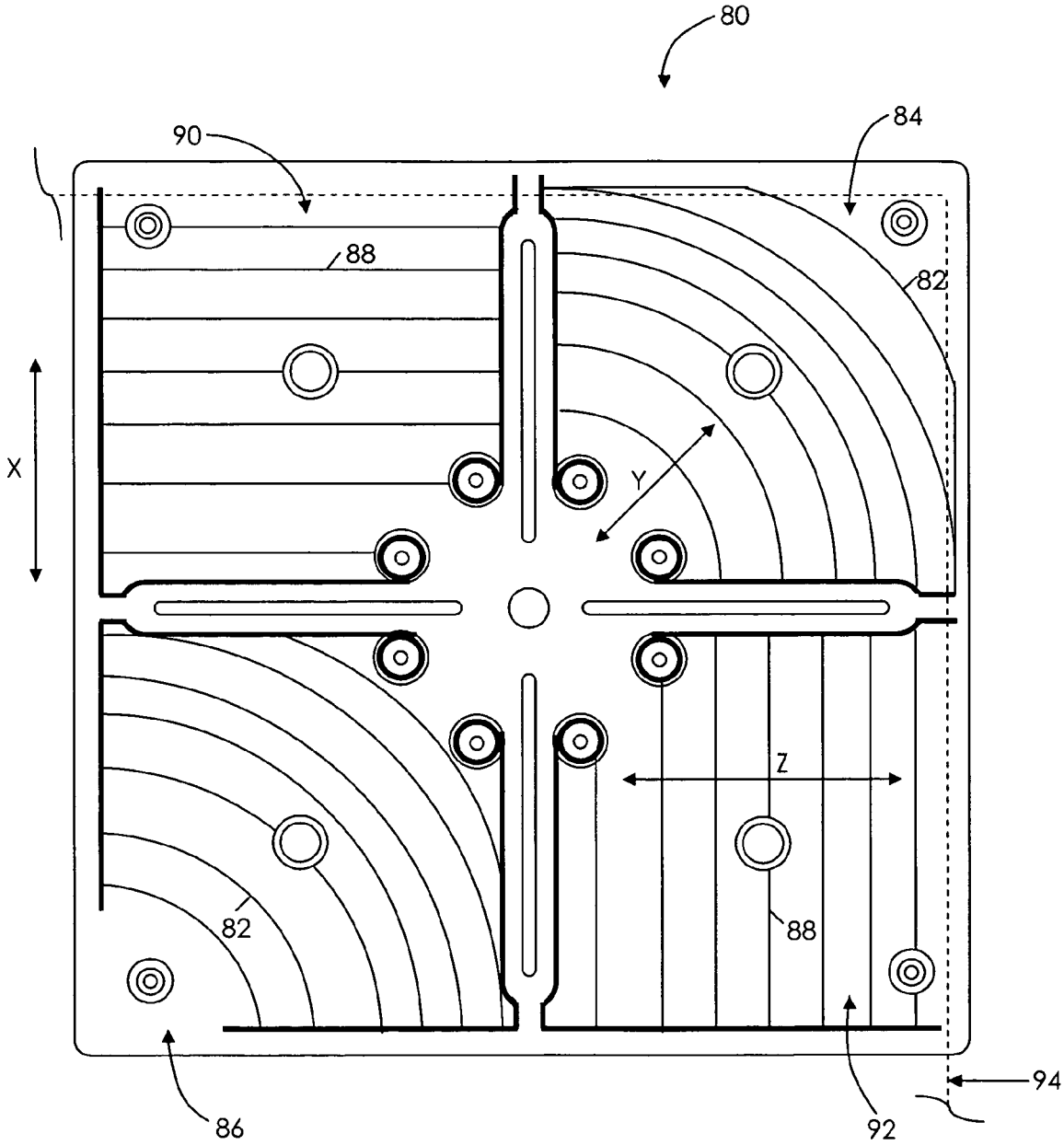
FIG. 4 is a top view of another embodiment of a layered heater module constructed in accordance with the principles of the present invention.

While the resistive traces 50 are illustrated in a linear configuration as shown in FIG. 2, the resistive traces may alternately be configured according to the position of the layered heater module 30 relative to the heating target in order to provide more efficient power distribution. As shown in FIG. 4, a layered heater module 80 comprises resistive traces 82 in quadrants 84 and 86 that are arranged in an arcuate configuration, while the resistive traces 88 in quadrants 90 and 92 remain in a linear configuration. Accordingly, the layered heater module 80 is designed to be positioned in a corner of a square heating target 94 (shown dashed) such that the arcuate resistive traces 82 and the linear resistive traces 88 are oriented approximately perpendicular to the primary heating directions of the heating target, illustrated by arrows X, Y, and Z. It should be understood that other configurations of resistive traces may be employed according to the direction of the primary heating directions of the heating target while remaining within the scope of the present invention. Accordingly, the description and illustration of linear and arcuate resistive traces should not be construed as limiting the scope of the present invention.

Figure 5:
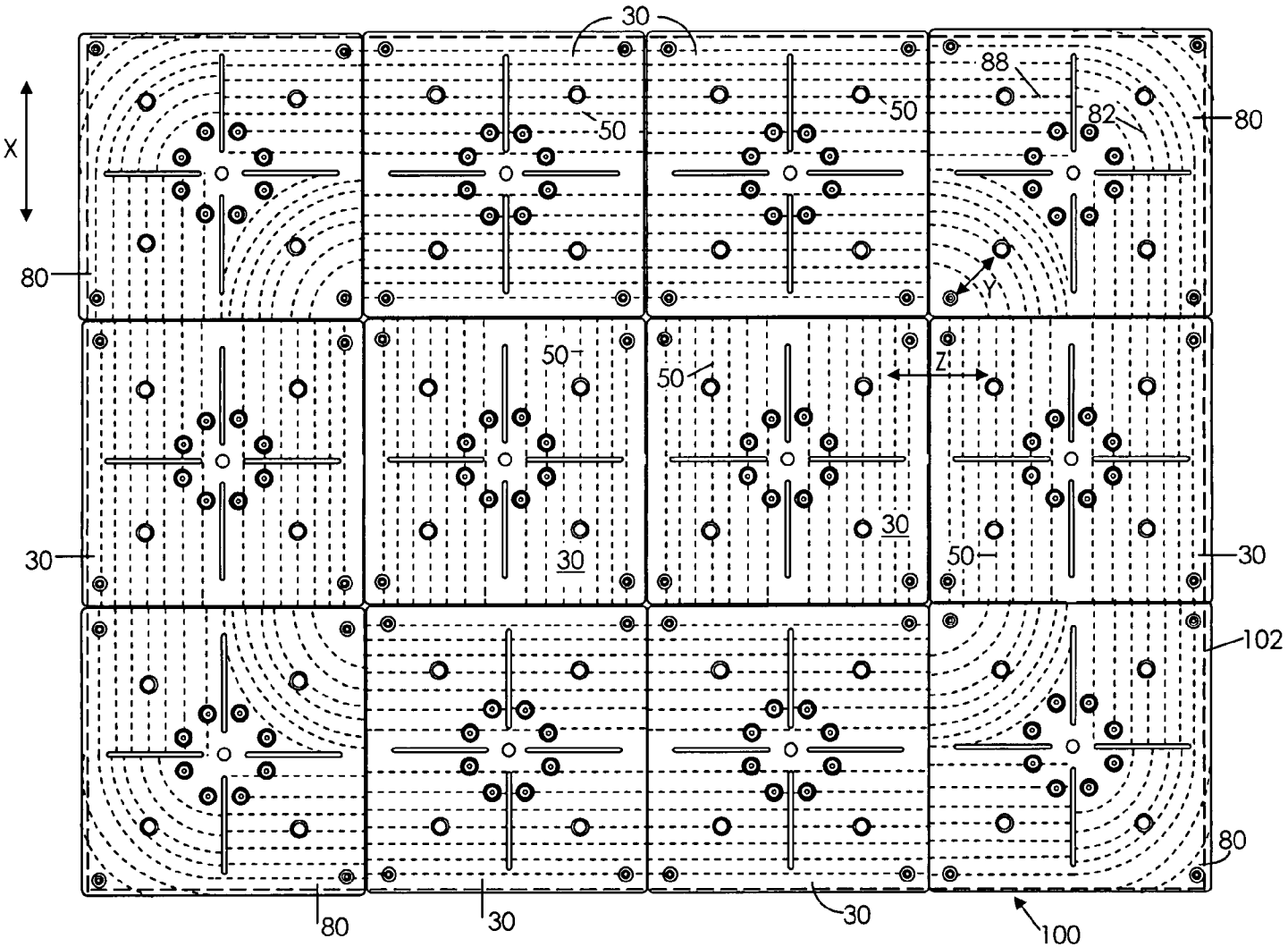
FIG. 5 is a top view of a layered heater system comprising a plurality of layered heater modules and constructed in accordance with the teachings of the present invention.

Referring now to FIG. 5, a plurality of layered heater modules 30 and 80 are disposed adjacent one another to form a layered heater system 100 that is sized for a specific size heating target 102 (shown dashed). Therefore, the layered heater system 100 comprises a 4×3 grid or array of layered heater modules 30 and 80. As shown, the layered heater modules 30 and 80 are preferably positioned such that the resistive traces 50, 82, and 88 are oriented approximately perpendicular to the primary heating directions of the heating target 102. Accordingly, any number of layered heater modules 30 and/or 80 may be arranged and positioned adjacent one another to accommodate a variety of sizes and heating directions of heating targets, therefore providing a modular layered heater system that eliminates the need for a separate, unitary heater that is sized for only one size heating target.

Figure 6:
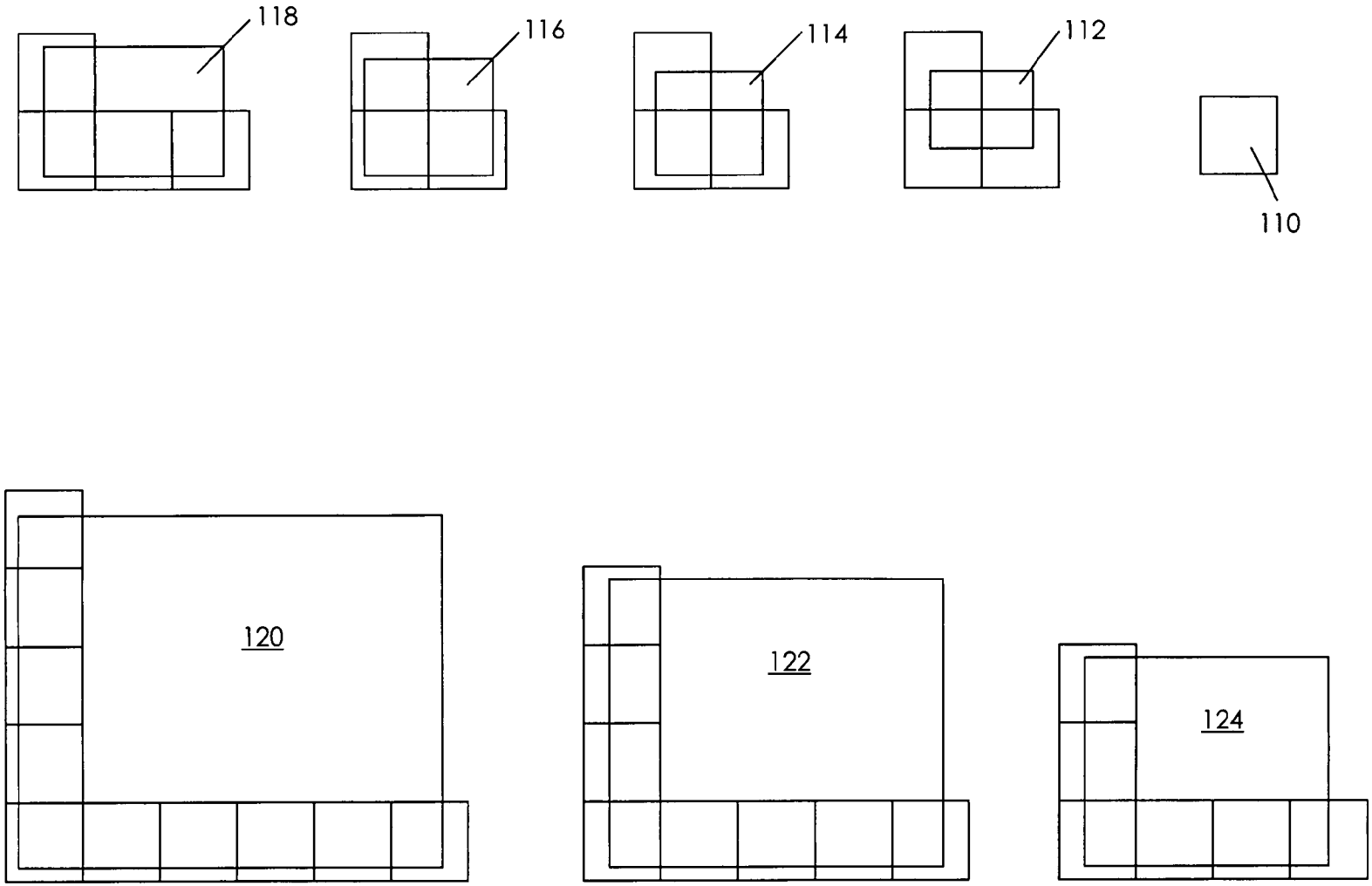
FIG. 6 is a top view of a plurality of layered heater modules arranged and sized according to a variety of heating target sizes in accordance with the principles of the present invention.

As shown in FIG. 6, the size of each layered heater module may be altered, e.g., 110, and the number of layered heater modules are arranged adjacent one another to substantially match the size of the heating target, e.g. glass panels 112 through 124. For example, a 2×2 array is used for heating target 112, 114, and 116, a 3×2 for heating target 118, a 6×5 for heating target 120, a 5×4 for heating target 122, and a 4×3 for heating target 124. Thus, a wide variety of combinations of layered heater modules may be employed according to the size of a specific heating target.

Additionally, the modular layered heater system is furthermore responsive to a heating target power gradient as illustrated and described herein. Furthermore, by employing the layered heater modules in accordance with the teachings of the present invention, the per-square-inch manufacturing cost of manufacturing smaller modules rather than individual heaters for each size heating target is substantially reduced. As a result, relatively large heating targets, e.g., glass panels, may be processed economically while providing smaller regions of individual power control.

The description of the invention is merely exemplary in nature and, thus, variations that do not depart from the gist of the invention are intended to be within the scope of the invention. For example, the layered heater system 100 and layered heater modules 30 and 80 as described herein may be employed with a two-wire controller as shown and described in co-pending application titled "Two-Wire Layered Heater System," filed Nov. 21, 2003, which is commonly assigned with the present application and the contents of which are incorporated herein by reference in their entirety. Additionally, the teachings of the present invention may be applied to for a layered heater system that comprises other than a flat geometry as illustrated herein, e.g., cylindrical or curved. Such variations are not to be regarded as a departure from the spirit and scope of the invention.

What is claimed is:

1. A heater system comprising:

a plurality of physically separate layered heater modules, each module comprising a plurality of resistive zones, and each resistive zone comprising a plurality of resistive traces adapted for connection to an adjacent module such that multiple resistive zones within multiple modules can be controlled together, wherein the layered heater modules further comprise mounting devices to secure the heater modules proximate an adjacent heating target and adjacent one another to form the heater system.

2. The heater system according to claim 1 further comprising a plurality of grooves disposed between the resistive zones for electrical and thermal isolation between the resistive zones.

3. The heater system according to claim 1, wherein the resistive traces of at least one resistive zone are arranged in a linear configuration and the resistive traces of at least another resistive zone are arranged in an arcuate configuration.

4. The heater system according to claim 1, wherein the resistive zones comprise a plurality of resistive traces oriented relative to a heating target and comprising a material having temperature coefficient characteristics such that the resistive traces provides power commensurate with demands of the heating target.

5. The heater system according to claim 1, wherein the resistive zones comprise a plurality of resistive traces arranged in a series circuit and oriented approximately parallel to a primary heating direction, the resistive traces comprising a negative temperature coefficient material having a relatively high BETA coefficient, wherein the resistive traces are responsive to the heating target power gradient such that the resistive traces output additional power proximate a higher heat sink and less power proximate a lower heat sink along the primary heating direction.

6. The heater system according to claim 1 wherein the mounting device comprises at least one aperture formed in each of the layered heater modules for mounting the layered heater modules to the heating target.

7. The heater system according to claim 1 further comprising at least one provision for the mounting of a sensing device.

8. The heater system according to claim 1, wherein the resistive zones are adapted for independent control.

9. The heater system according to claim 7, wherein the provision comprises an opening in at least one module.

10. The heater system according to claim 7, wherein the sensing device comprises a thermocouple.

11. A heater system comprising:

a plurality of physically separate layered heater modules, each module comprising a plurality of resistive zones, and each resistive zone comprising a plurality of resistive traces adapted for connection to an adjacent module such that multiple resistive zones within multiple modules can be controlled together, each layered heater module comprising:

a substrate;

a dielectric layer formed on the substrate;

a resistive layer formed on the dielectric layer; and a protective layer formed on the resistive layer, wherein the layered heater modules further comprise mounting devices to secure the heater modules proximate an adjacent heating target and adjacent one another to form the heater system.

12. The heater system according to claim 11 further comprising a plurality of grooves disposed between the resistive zones for electrical and thermal isolation between the resistive zones.

13. The heater system according to claim 11, wherein the resistive traces of at least one resistive zone are arranged in a linear configuration and the resistive traces of at least another resistive zone are arranged in an arcuate configuration.

14. The heater system according to claim 11, wherein the plurality of resistive traces are oriented relative to a heating target and comprise a material having temperature coefficient characteristics such that the resistive traces provide power commensurate with demands of the heating target.

15. The heater system according to claim 11, wherein the plurality of resistive traces are arranged in a series circuit and oriented approximately parallel to a primary heating direction, the resistive traces comprising a negative temperature coefficient material having a relatively high BETA coefficient, wherein the resistive traces are responsive to the heating target power gradient such that the resistive traces output additional power proximate a higher heat sink and less power proximate a lower heat sink along the primary heating direction.

16. The heater system according to claim 11 wherein the mounting devices comprise at least one aperture formed in each of the layered heater modules for mounting the layered heater modules to a heating target.

17. The heater system according to claim 11 further comprising at least one provision for the mounting of a sensing device.

18. The heater system according to claim 11, wherein the resistive zones are adapted for independent control.

* * * * *